US006626235B1

(12) United States Patent
Christie

(10) Patent No.: US 6,626,235 B1
(45) Date of Patent: Sep. 30, 2003

(54) MULTI-TUBE HEAT EXCHANGER WITH ANNULAR SPACES

(76) Inventor: Ignas S. Christie, 7006 Lehman St., Clay, NY (US) 13041

( * ) Notice: Subject to any disclaimer, the term of this patent is extended or adjusted under 35 U.S.C. 154(b) by 0 days.

(21) Appl. No.: 10/242,073

(22) Filed: Sep. 12, 2002

Related U.S. Application Data

(60) Provisional application No. 60/325,477, filed on Sep. 28, 2001.

(51) Int. Cl.[7] ..... F28D 7/10; F28F 9/02

(52) U.S. Cl. ..... 165/158; 165/81; 165/163

(58) Field of Search ..... 165/81, 109.1, 165/154, 158, 140, 177, 163; 138/38

(56) References Cited

U.S. PATENT DOCUMENTS

| | | | | | |
|---|---|---|---|---|---|
| 83,796 | A | * | 11/1868 | Sabin | 165/140 |
| 164,757 | A | * | 6/1875 | North | 165/140 |
| 1,203,625 | A | * | 11/1916 | Jacobus | 138/38 |
| 1,798,330 | A | * | 3/1931 | Leek | 165/141 |
| 1,862,310 | A | * | 6/1932 | How | 165/158 |
| 2,303,613 | A | * | 12/1942 | Charlton | 165/160 |
| 2,541,069 | A | * | 2/1951 | Jones et al. | 210/176 |
| 2,658,729 | A | * | 11/1953 | Horwitz | 165/68 |
| 2,898,384 | A | * | 8/1959 | Viriot | 570/255 |
| 3,071,159 | A | * | 1/1963 | Coraggioso | 138/38 |
| 3,386,497 | A | | 6/1968 | Feldmeier | |
| 3,921,711 | A | | 11/1975 | Westbrock | |
| 3,982,901 | A | * | 9/1976 | Steever et al. | 422/143 |
| 4,287,944 | A | * | 9/1981 | Becker | 165/158 |
| 4,443,389 | A | * | 4/1984 | Dodds | 261/153 |
| 4,593,754 | A | | 6/1986 | Holl | |
| 4,679,622 | A | | 7/1987 | Cannon | |
| 4,784,218 | A | * | 11/1988 | Holl | 165/109.1 |
| 4,884,629 | A | * | 12/1989 | Bronnert | 165/159 |
| 5,375,654 | A | * | 12/1994 | Hougland et al. | 165/109.1 |
| 6,092,589 | A | * | 7/2000 | Filius et al. | 165/109.1 |

* cited by examiner

*Primary Examiner*—Allen Flanigan
(74) *Attorney, Agent, or Firm*—David T. Bracken

(57) ABSTRACT

A multi tube heat exchanger with a bundle of small tubes surrounded by one large shell tube is provided. Each small tube has a smaller tube in the center. Product flows in the multiple annular spaces between the tubes while heating or cooling medium flows in the shell side. This arrangement provides high shear rate and results into high heat transfer rates and while still resulting in lower pressure drops for thick food products like tomato paste, catsup, sugar syrups and similar products.

15 Claims, 13 Drawing Sheets

MULTI-TUBE HEAT EXCHANGER WITH ANNULAR SPACES

This application is a continuation in part of Provisional Patent Application No. 60/325,477, filed on Sep. 28, 2001.

FIELD OF INVENTION

The present invention relates to heat exchangers. In particular, it relates to a multi tube heat exchanger for exchanging heat between two fluids.

BACKGROUND OF THE INVENTION

Heat exchangers are used in many industries including food industry. A variety of heat exchangers are used depending upon specific application and so plate heat exchangers, tubular heat exchangers, shell and tube heat exchangers and scraped surface heat exchangers, etc. are used widely in the food industry. Prior art heat exchangers are efficient and cost effective when the fluids passing through them are Newtonian flow and have low viscosities. The capital and operating cost effectiveness depends in large part on the ability to use small diameter tubes to improve heat transfer to the tube side fluid.

However, a number of food products are thick Newtonian fluids, showing linear relationship between shear stress and shear rates and having very high apparent viscosities. Also, a large number of food slurries are non-Newtonian liquids with a very high apparent viscosity. Because of high viscosities, the operating pressure drop through conventional heat exchangers with small tubes rises to uneconomic levels, making high flow very costly due to pumping power and capital costs. The higher pressure drop requires one or more positive displacement pumps, which increase both the capital and operating costs.

One prior art method to reduce high operating pressures is to reduce product flow rates through small tube heat exchangers by arranging product flow in many parallel streams. Lower flow rates on the other hand result in lower heat transfer rates that requires an uneconomic increase in large heat transfer area. Increasing heat transfer area results into more capital investment, more space requirement and significant product loss in cleaning, a rather frequent requirement for food processing. Further, reducing flow rates for non-Newtonian fluids causes higher apparent viscosities at operating pressures, temperatures and flows. Therefore, for non-Newtonian fluids, lowering flow rates does not significantly reduce operating pressure drops.

The "coring effect" is the tendency in a double tube heat exchanger (with the product carried in the inner tube and the cooling/heating fluid in the annular space between the inner and outer tube) for a central portion of the product stream in the inner tube to move faster than the rest of the material at the tube boundary where heat transfer takes place. The central portion or the "core" of the product does not experience any significant mixing and so heat transfer is decreased. The coring effect is more pronounced as the tube diameter of the inner tube is increased and the viscosity of the product increased. Turbulators are inserted to disturb the central portion of thick product flow in the inner tube by creating turbulence. These turbulators have different shapes from an augur or spiral like shapes and run through the length of the inner tube. Another type of turbulator is simple smooth surface insert in the second tube, i.e., a tube turbulator, occupies a small cross section area at the center of the second tube. Placement of tube turbulators thus creates an annular space through which the product flows, but the prior art devices provide for a very wide annular space. For example, a tubular heat exchanger with 4" outer tube and 3" inner tube may have a tube core of ¾" diameter. Thus it will create an annular space of 1.08" which is very wide. Application of these cores are limited to double tube heat exchangers with inner tube of larger diameter and are not placed inside an inner tube with say 1" diameter as "coring" or "layering" effect is very insignificant as the inner tube diameter decreases.

Multi-tube heat exchangers provide more heat transfer surface as it employs a bundle of small diameter tubes through which product flows and an outer tube enclosing the bundle of small tubes. It makes the heat exchanger more compact than the double tube heat exchanger and thus require a smaller foot print. The outer shell diameter could vary from 3" to 8" while the inner small tubes are predominantly of ½" to ¾" diameter and up to 1" in some cases. These heat exchangers are widely used for heat exchange applications in food industry but they do not work well for thicker food products especially those having very high viscosity at lower shear rate because very high pressure drops are developed and typical slow product velocity results into lower heat transfer.

Scraped surface heat exchangers handle this type of fluids very efficiently but again they are expensive and also require constant maintenance. Some other kinds of tubular heat exchangers with corrugations are offered but they are difficult to clean as they do not drain well and also more expensive because of special. design and fabrication.

One application of tubular heat exchangers in food industry is for energy regeneration where heat exchange takes place between a hot and cold product streams which is termed as 'product-to-product' regeneration or direct regeneration. Direct regeneration for thin products is usually carried out employing a double tube or a triple tube heat exchanger. Direct regeneration becomes increasing difficult as the product viscosity increased as prevailing laminar flow situation not only drastically reduces overall heat transfer coefficient but also difficult to clean in place as uneven velocities of cleaning solutions. For these types of application, an indirect regeneration or 'water-to-product' regeneration is employed where water in close loop recovers heat energy from a hot product in a cooling regenerator and gives back this heat energy to cold product stream in a heating regenerator. Double tube heat exchangers or multi-tube heat exchangers are used for indirect regeneration. A lower heat transfer rate and high pressure drop limitations for a thick non-Newtonian fluid results in a large heat exchanger surface requirement. A triple tube heat exchanger is not preferred for this types of heat application even though it employs product annular space.

Triple tubes and double tubes have a large exposed surface to heat transfer surface ratio which means that heat loss and refrigeration loss to surroundings is high if the tubes are not properly insulated. This ultimately results in lower thermal effectiveness in comparison to plate heat exchanger and multi-tube heat exchangers. For example a 2½"×1½" double tube has exposed surface to heat transfer area ratio of 1.66 while a multi tube heat exchanger with 2½" outer tube and ½" inner tubes will have this ratio as 0.71. The insulation costs are therefore higher in tubular heat exchanger as compared to multi tube heat exchangers.

In triple tube heat exchanger employed as a regenerator, there are two annular cross sections and one circular cross section through which the hot and cold streams of product flow. In U.S. Pat. No. 3,386,497, a hollow core tube has been inserted in inner round tube of a triple tube regenerator for thick food products like tomato paste to reduce "layering" or "coring" of the product in round cross section of the inner tube. The use of tube turbulators or cores in double tube heat exchanger and triple tube heat exchanger, as described in U.S. Pat. No. 3,386,497, changes the product flow from "flow through round cross section" into "flow through an annular cross section" and thus reaps the benefits of superior heat transfer characteristics of an annular space. However, this arrangement does not address the issue of making tubular heat exchanger more compact. Bulkiness is one of the inherent limitations of tubular heat exchanger and this limitation further gets amplified when thick food products are handled by tubular heat exchangers. This patent shows an example of the prior art thinking to use a tube turbulator, although it is apparent that tube turbulators have not been advanced as a technical improvement since the 1968 date of this patent. The more recent and consistent approach to this problem of improving economically effective flow rates and heat transfer surface areas are shown in U.S. Pat. Nos. 3,921,711 and 4,593,754 where extremely irregular surfaced turbulators are used to increase turbulence. The problem of cleaning the triple tube exchanger is illustrated in U.S. Pat. No. 4,679,622. For heat exchangers with small hydraulic cross sections, an economically adequate velocity above about 3 ft/sec or higher is needed for cooling thick food slurries and would result in extremely high pressure drops through these heat exchangers, raising pumping costs to impossibly expensive levels. The slurry side tubes in non-insert exchangers used for cooling thick food slurries have an inner diameter of 12 mm and larger due to the high capital and utilities costs for smaller diameter tubes, where the necessarily slow velocities result in flow in laminar region.

BRIEF SUMMARY OF INVENTION

An object of the present invention is to provide a heat exchanger which works well for non-Newtonian especially shear thinning food slurries like tomato ketchup, concentrated fruit juices, sauces, fruit purees etc. achieving a higher beat transfer rates with comparatively lower pressure drops than the known tubular heat exchangers. This will reduce the capital investment.

Another object of the present invention is to provide heat exchanger that is compact in size, requiring less floor space.

Another object of the present invention is to provide heat exchanger, which holds lower volume of product and thus minimizes product loss.

Another object of the present invention is to provide a heat exchanger that lowers heat and refrigeration loss and also costs less to insulate.

Another object of the present invention is to provide a heat exchanger, which is easy to clean and maintain.

Another object of the present invention is to provide a heat exchanger, which can be easily customized to permit optimization of flow velocity and heat exchanger area for a variety of applications.

The foregoing objects are accomplished by the present invention, which is a multi tube heat exchanger but unlike a conventional multi tube heat exchanger, where the product flows through the smaller tube bundles, here the product flows in the multiple annular spaces while the medium flows in the shell side. The heat exchanger comprises of three main sections: middle section, inlet chamber at one end of the middle section and an outlet chamber at the opposite end of the middle section. The middle section is like shell and tube heat exchanger having two lengths of a large tube connected by an expansion joint near one end. Middle section has one tube sheet welded at each end and a numbers of small tubes whose both ends are welded or expanded into these tube sheets. The tube ends are flush with the tube sheet. The outermost tube of the middle section has connections for inlet and outlet for the medium.

The inlet and outlet flow chambers are identical in construction except that the inlet and outlet connections are in opposite ends to each other or in any suitable place for appropriate product and media connection. The chambers have a tube section with one end having a matching flange that fits with the tube sheet of the middle section at one end. The other end of the chamber has a tube sheet having number of bores equal to those of the tube sheets on the middle section and this tube sheet connects to another tube sheet with matching number of bores. The bores in the tube sheet at the end of flow chamber are larger than the core diameter, widening further towards the matching tube sheet. This tube sheet has holes, which are smaller than the tube sheet on the chamber but large enough to easily pass the cores through them. Both these tube sheets are held together with a quick release sanitary clamp. A number of smaller core elements pass through these tube sheets at one end of the module, through the small tubes in the middle section and through similar chamber on the opposite side of the middle section of the module. Each core element is either a solid round bar or a smooth tube or pipe. Each tube in the middle section thus has one smaller core element in the center. These cores are smaller in diameter than the tubes in the middle section and thus form a number of annular spaces equal to the number of small tubes passing through the middle section. A gasket fits into each annular tapering space between core passing through the hole in the tube sheet of flow chambers at both ends of the module. These gaskets are pressed against the core surface and tube sheet by the last tube sheet when both tube sheets at the end of the module are connected together by a quick release clamp. A leak proof joint is thus formed which prevents leakage of fluid from the chamber to outside.

Product enters the heat exchanger through the inlet port of the inlet chamber, pass through the annular spaces through the middle section and come out of the opposite end through outlet chamber. Medium on the other hand enters middle section through the inlet port which is at the outlet chamber end, pass through the shell side and come out of the other end of middle section, thus forming a counter current flow between product.

The rate of heat transfer between a thick liquid food and heating or cooling medium in a thin walled heat exchanger is a special case in that the over-all-heat transfer coefficient is mainly governed by the heat transfer coefficient on the product side. This is so because the product flow is mostly is laminar as a result of the very high viscosity of the product, while media side is always designed to have turbulent flow. Heat transfer rate in this case can only be increased if the heat transfer coefficient on the product side is increased. Higher shear rates in annular spaces as encountered in the present invention increases heat transfer coefficients. Higher shear rates also results in lower pressure drops as explained in following paragraphs.

Because of the geometry of the annular space, the distance-from the maximum velocity region which lies somewhere near the center, to the wall where the velocity is zero—is less in comparison to the circular cross section tube of the same cross sectional area. And so, shear rates in an annular space are higher than in circular space of the same cross sectional area. Depending upon the diameter ratios of the tubes and flow behavior index of the fluid, the shear ratios can be as high as 2 to 2.5 times that in circular cross sections. Now, non-Newtonian fluids especially shear thinning foods (most foods fall in this category) show a lower apparent viscosity at higher shear rates than at lower shear rates. It follows from this that due to higher shear rates in the new design results into a lower pressure drop for a given flow rate.

The superior heat exchange efficiency of annular space is known to prior art and so is widely used in food industry in the form of triple tubes for Newtonian fluids with lower viscosity values for products like milk and juices. Its use for very thick Newtonian and non-Newtonian fluids is limited at present because of very high pressure drops encountered in these heat exchanger in the present form as the known design does not permit an optimum combination of shear rates and pressure drops. Another reason is that application of triple tubes for this type of application becomes more expensive. One reason for the high cost of triple tube is that it requires a third larger tube around each product annulus. In the present invention the cost is reduced by elimination of separate outer tube on each annulus by a single large shell surrounding all annuli. This arrangement provides for a large heat exchange areas and makes this beat exchanger very compact.

Since, for a given product flow rate higher heat transfer rates are achieved, a smaller heat transfer area is required which makes the heat exchanger further compact. Since for any given flow rate and heat transfer area pressure drops are lower than the known tubular heat exchanger designs, product flow rate could be increased which further increases heat transfer rates. Thus higher heat transfer rate and lower pressure drops for a specific heat transfer application, result in a heat exchanger that is more compact and requires less floor space. In short, the new design offers the superior heat exchange capability and low pressure advantage of the product annular space as in a triple tube and the compactness and of a multi tube heat exchanger.

Since the new design requires less heat transfer area, number of tube required is reduced and so the product hold up in these tubes is reduced.

Tubular heat exchangers have comparatively large areas exposed to surrounding which results in a higher heat transfer between heat exchanger and surrounding. This results into substantial heat losses or refrigeration losses, which not only means higher energy requirement but also means a lower higher thermal effectiveness and larger approach temperature. The present invention by way of its compactness lowers down the exposed surface resulting into lower cost of insulation and a better thermal efficiency.

The present design is simple in comparison to the scraped surface heat exchangers as there are no moving mechanical parts and hence it is easy to maintain. Further product flows without any obstructions and so it is easier to clean also. Also, the inner surface of the tube outer tube in the annular space is flush with the inner surface of the inlet and outlet chambers, which facilitates easy draining of the tubes.

All these improvements in the performance of the heat exchanger make it very suitable for product like tomato paste, heavy milk cream, concentrated fruit juices and sugar syrups etc.

BRIEF DESCRIPTION OF THE DRAWINGS

The accompanied drawings describe the complete embodiment of the invention, which represent the best mode devised for the practical application of the invention.

DETAILED DESCRIPTION OF THE INVENTION

Figure 1:
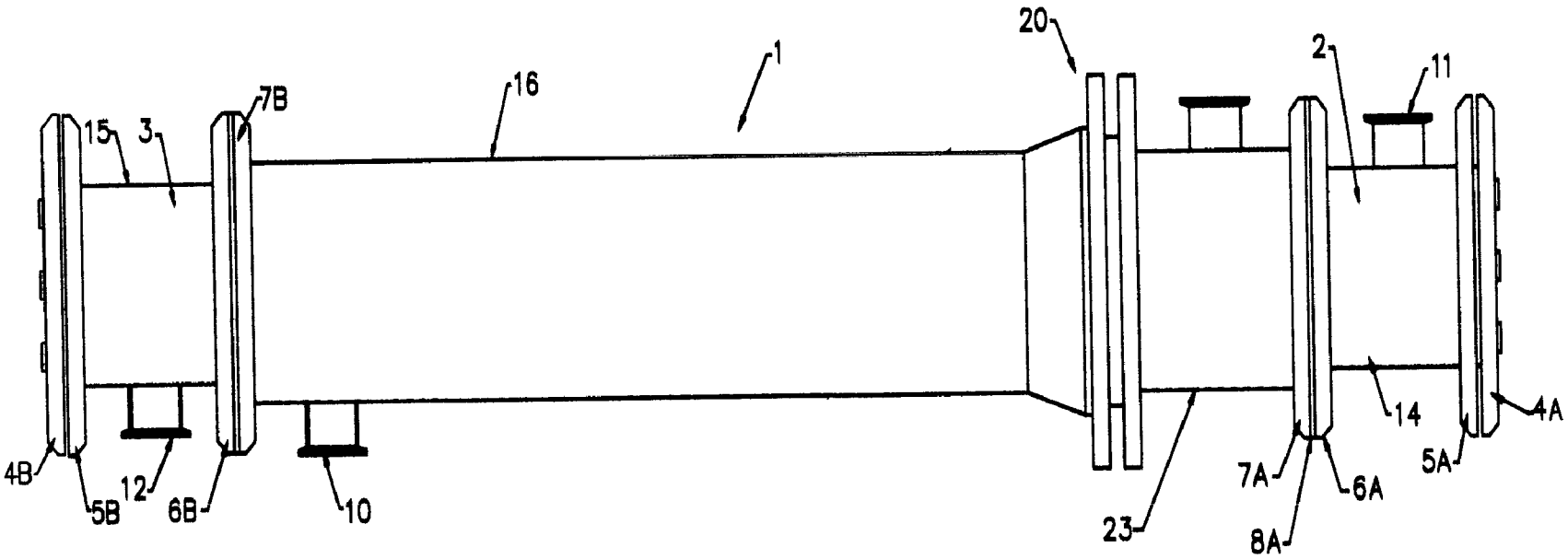
FIG. 1 is a front view of a single heat exchanger module.
Figure 2:
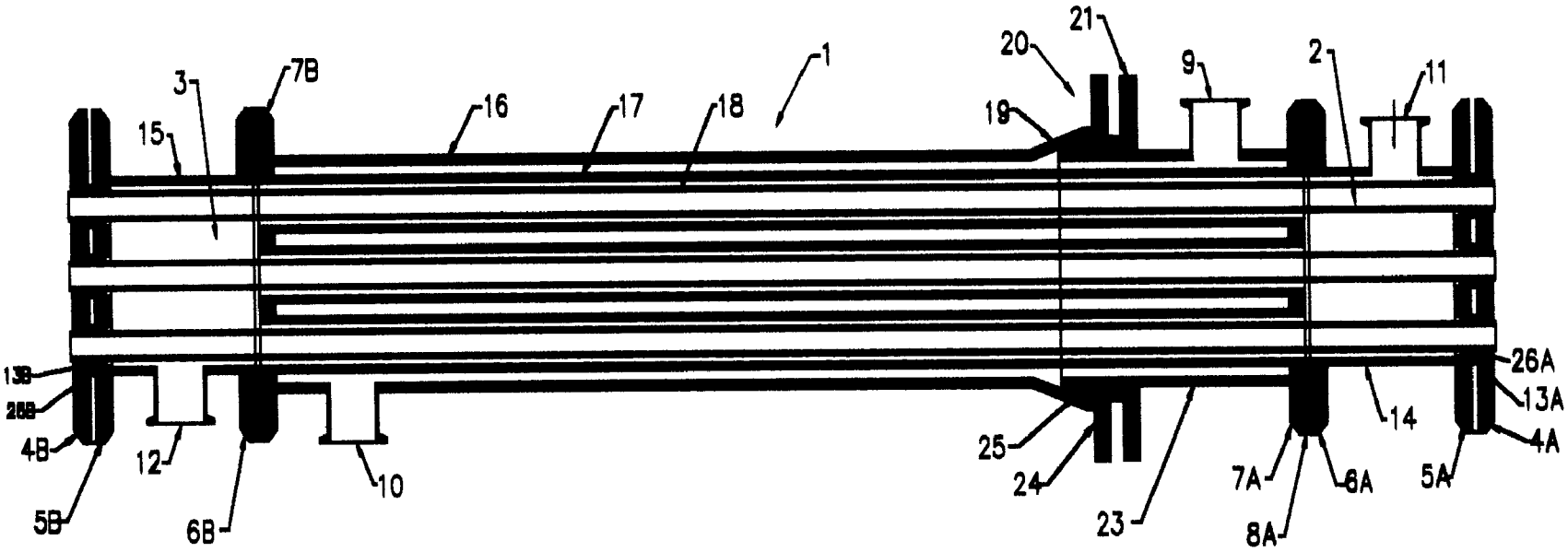
FIG. 2 is a cross sectional view of the module
Figure 3:
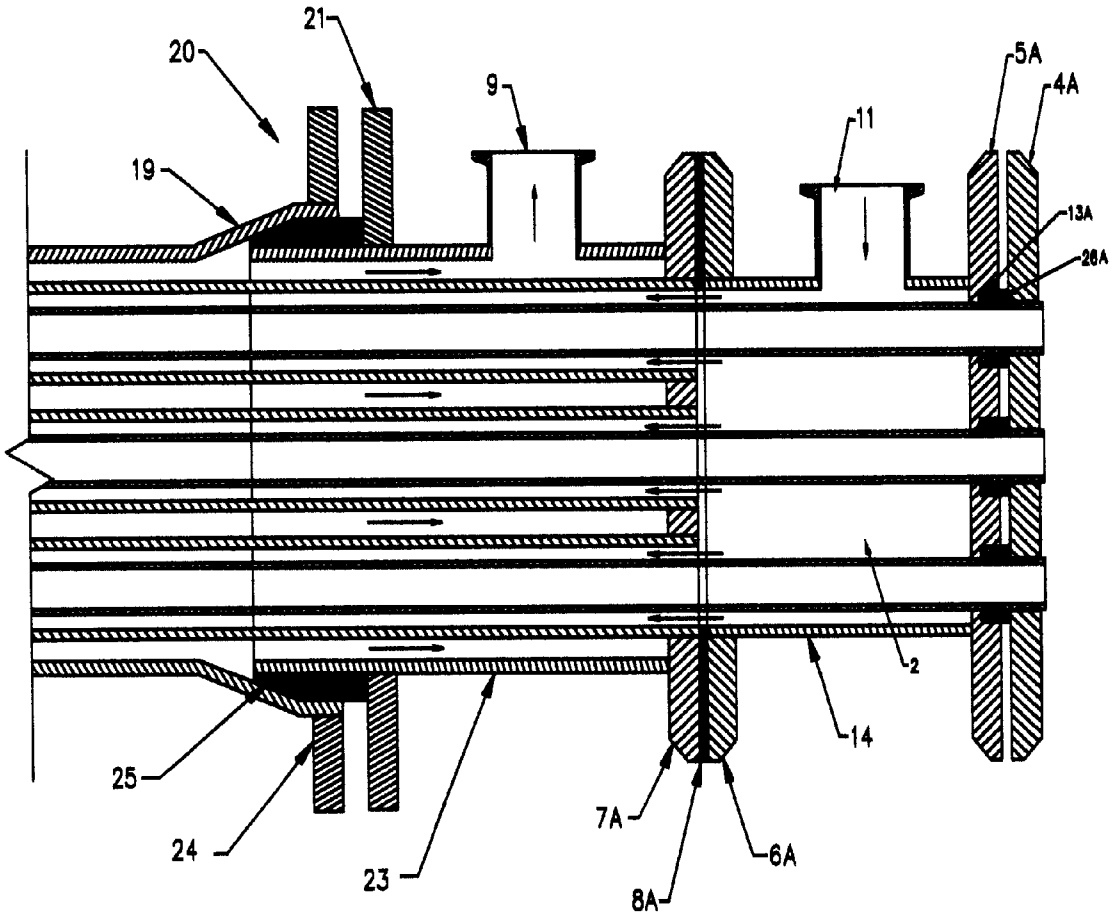
FIG. 3 shows enlarged cross sectional view of the product inlet chamber
Figure 4:
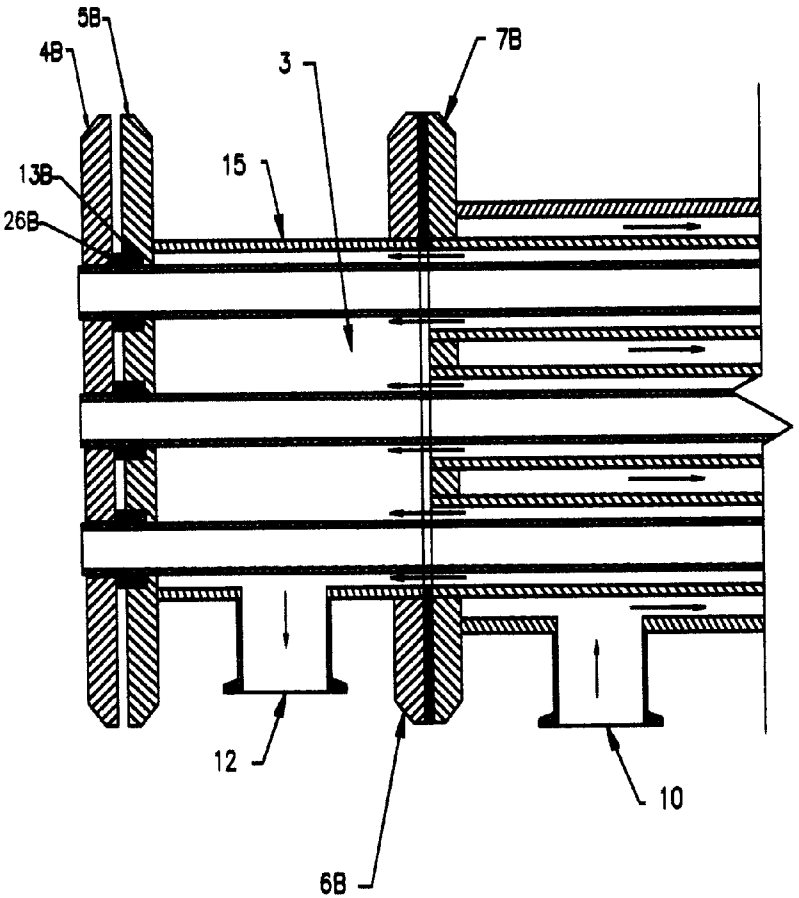
FIG. 4 shows enlarged cross sectional view of the product outlet chamber
Figure 7:
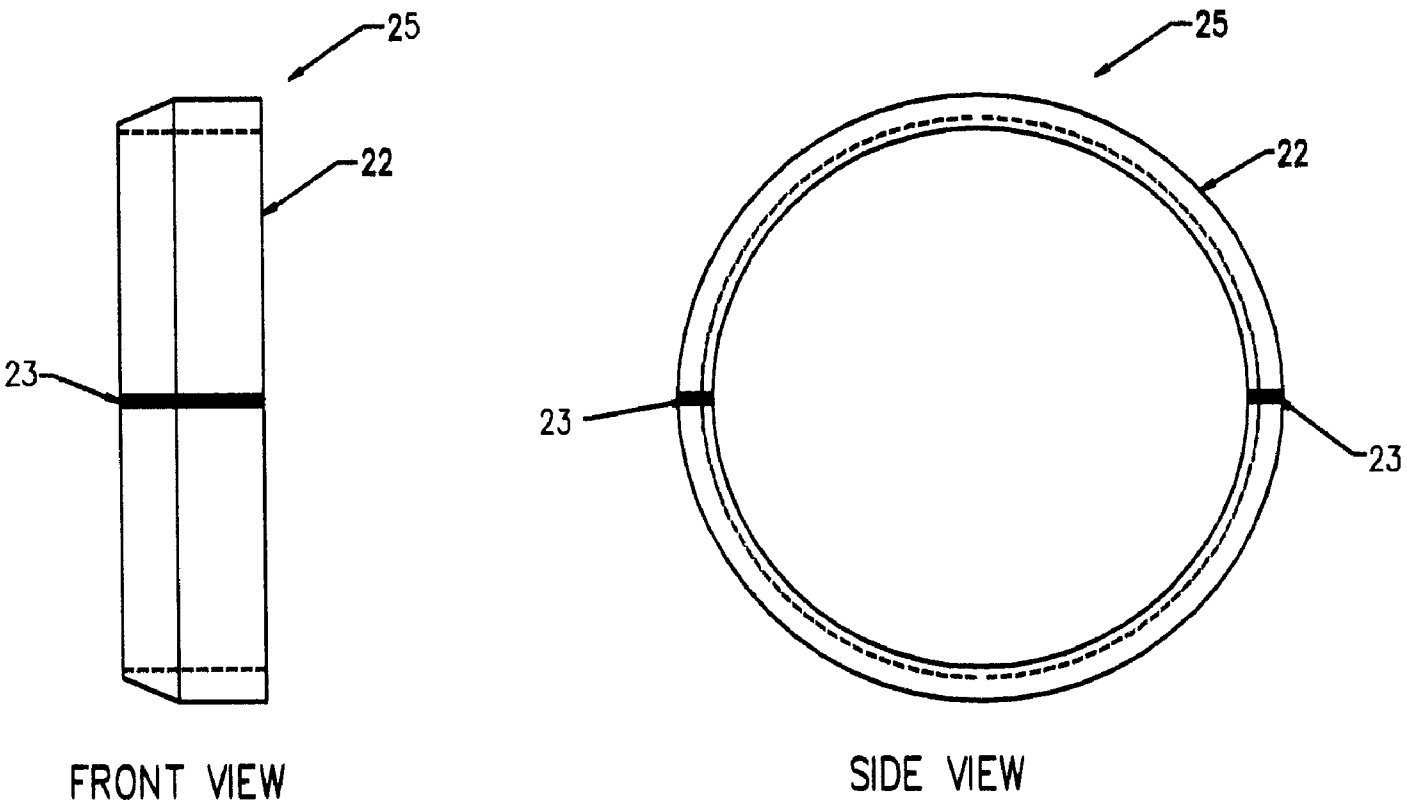
FIG. 7 shows two views of the bushing assembly for expansion joint.

The heat exchanger of the present invention allows for the exchange of heat between two fluids and especially between a thick liquid food and heating or cooling media. Although the present invention is described as a single heat exchanger module, several such modules can be streamed in parallel and/or series to suit a specific product and application. The heat exchanger module in essence consists of middle section 1, a product inlet chamber 2 at one end and outlet chamber 3 at the other end of the middle section. FIG. 1 shows front view of a typical heat exchanger module and FIG. 2 shows a cross section view of the heat exchanger module. Various parts, which are similar in construction and function, are designated by placing suffix A and B; for example, first tube sheet is designated as 4A and 4B. The middle section 1 consists of two lengths of outer tube 16 and 23 joined by an expansion joint 20; middle tubes 17 and tube sheets 7A and 7B at each end. These tube sheets are welded to the outer tubes 16 and 23 at both ends. Expansion joint consists of a conical-cylindrical section 19, fixed flange 24, moveable flange 21 and a bushing assembly 25. At one end of the outer tube piece 16, conical-cylindrical piece 19 is welded, while the other end is welded to a tube sheet 7B. Conical-cylindrical piece 19 is fabricated by taking a small tubular length of tube having the same diameter as the outer tube 16 and swaging at one end so that conical shape is formed at one end leaving cylindrical portion at the other end. On the conical end a small length of cylindrical piece with diameter larger than that of the outer tube 16 and matching that of the conical section is welded. Thus this piece has cylindrical sections at both ends and conical in the middle. The larger end of the conical-cylindrical piece 19 is expanded into or welded to flange 24. One end of outer tube piece 23 is welded to tube sheet 7A. Flange 21 has a bore drilled into it so that outer tube 23 can be easily slid through it. After securing tubesheet 7A at one end, the other end of outer tube piece 23 is guided into the conical end of outer tube 16. Before this, flange 21 is slid over outer tube piece 23. The details of expansion joint 20 is shown in FIG. 3 which shows an enlarged view heat exchanger end having product inlet chamber 2. Tube sheets 7A and 7B have bores drilled through them. There are as many bores as are the middle tubes 17 and diameter of the bores is about the same as the outer diameter of these tubes. Middle tubes are inserted into these bores from one tubesheet at one end, passing through the middle section 1 and through matching bores of the opposite tubesheet. The ends of middle tubes 17 are then expanded into welded onto the tubesheets 7A and 7B. An annular space with one end tapered is created between conical-cylindrical section 19 and outer surface of outer tube 23. A bushing assembly 25 with matching shape and dimension is inserted into this space. Bushing assembly 25 has two halves 22 with two pieces of flat gasket 23 are placed between them as shown in FIG 7. Bushing halves 22 are made of hard synthetic material such as Teflon and the flat gasket is made of synthetic rubber like nitrile rubber. When two bushings and flat gaskets are arranged as shown in FIG. 7, a bore is formed in the center. This bore diameter is slightly smaller than the outer diameter of outer tube piece 23. When bushing assembly is placed in the space below conical cylindrical section 19 and both flanges 21 and 24 are secured together with nuts and bolts, a leak proof seal is created preventing any leakage of medium and at the same time allowing lateral relative movements of outer tubes 16 and 23 due to thermal expansion and contraction.

Through each middle tube 17 of the middle section, passes one internal core 18, which is smaller in diameter than the middle tubes 17. Although the cores are shown as hollow tube in the present invention, they can be solid also, as no liquid flows through them. A number of annuli are formed between the core and middle tube in the middle section 1 and product flows through these annuli. The middle section thus becomes the area of heat exchange where heat transfer takes place between product stream in the annular space and medium in the shell. The heat exchanger module presented here consists of seven annuli, but this number could be any depending upon a specific application, so as to have an optimum shear rate and pressure drop combination. The middle tube may have a plain surface or a modified surface to generate some turbulence at the heat transfer region. This modification of surface is accomplished by any method known to those skilled in the art. The product inlet and outlet chambers are mirror images of each other except for the inlet and outlet ports which are located at opposite ends or other suitable places on the chamber tube 14 and 15 so as to facilitate easy connections with other modules in the case where more than one such modules are required to be connected in series.

Figure 5:
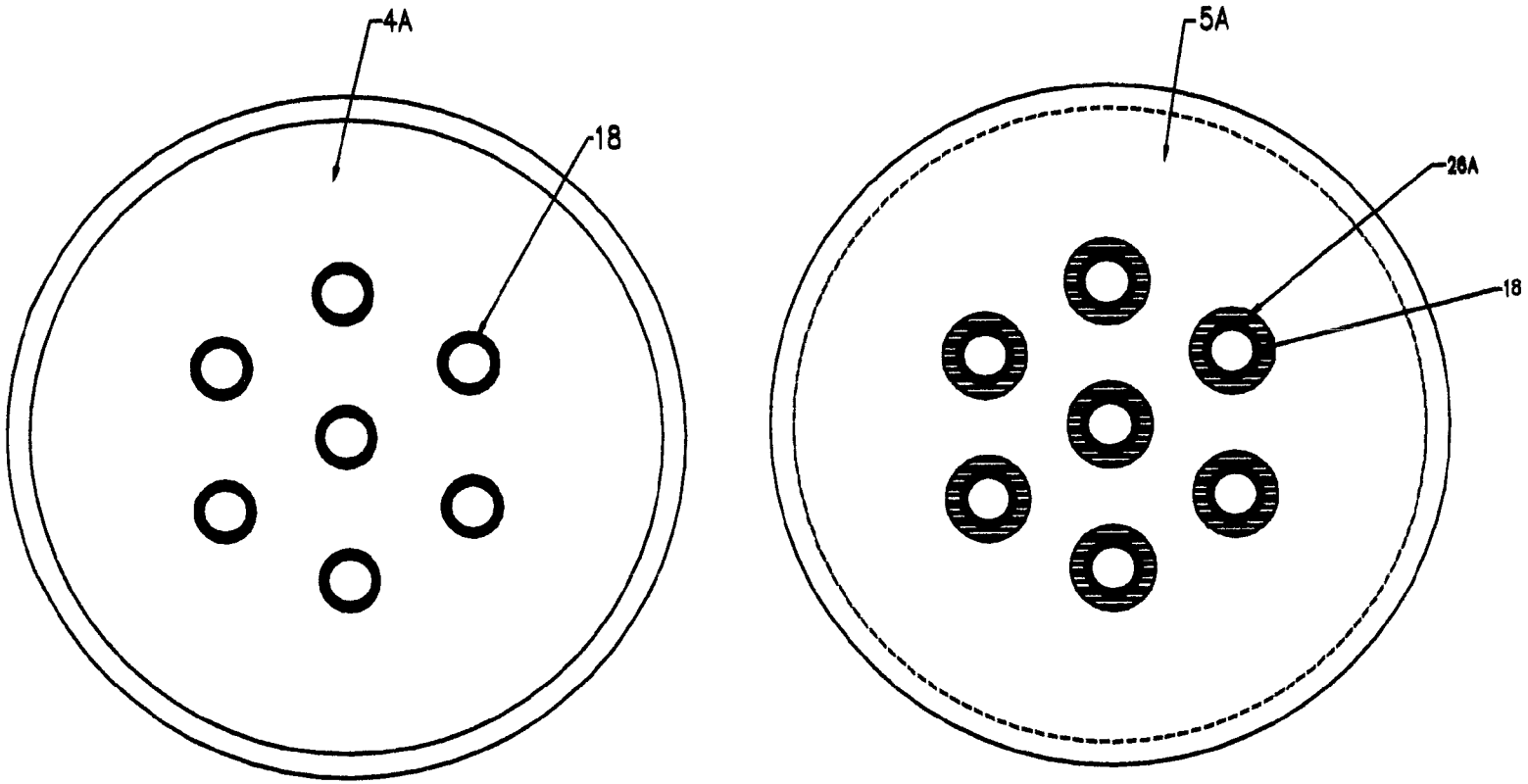
FIG. 5 shows details of the tube sheets on the product inlet chamber as viewed from product inlet side. These view also show cross sectional views of gaskets and cores.

Product inlet chamber 2 consists of a tubular section 14 having a flange 6A at one end and a tube sheet designated as second tube sheet 5A at the other end. Second tube sheet is connected to another tube sheet designated as the first tube sheet 4A. First tube sheet has holes drilled through it, which are somewhat larger than the core diameter. Second tube sheet 5A has equal number of matching bores that are larger than those in the first tube sheet 4A. These holes are tapered with increasing diameter towards the first tube sheet. A gasket 13A is inserted in each of the hole, which seals the inner core's 18 outer surface and second tube sheet 5A. These gaskets are made of food grade Teflon or similar hard synthetic material like. FIG. 5 shows tube-sheets 4A and 5A as viewed from side of the heat exchanger. For better perspective, cross section views of cores and gaskets 13A are shown also.

Figure 6:
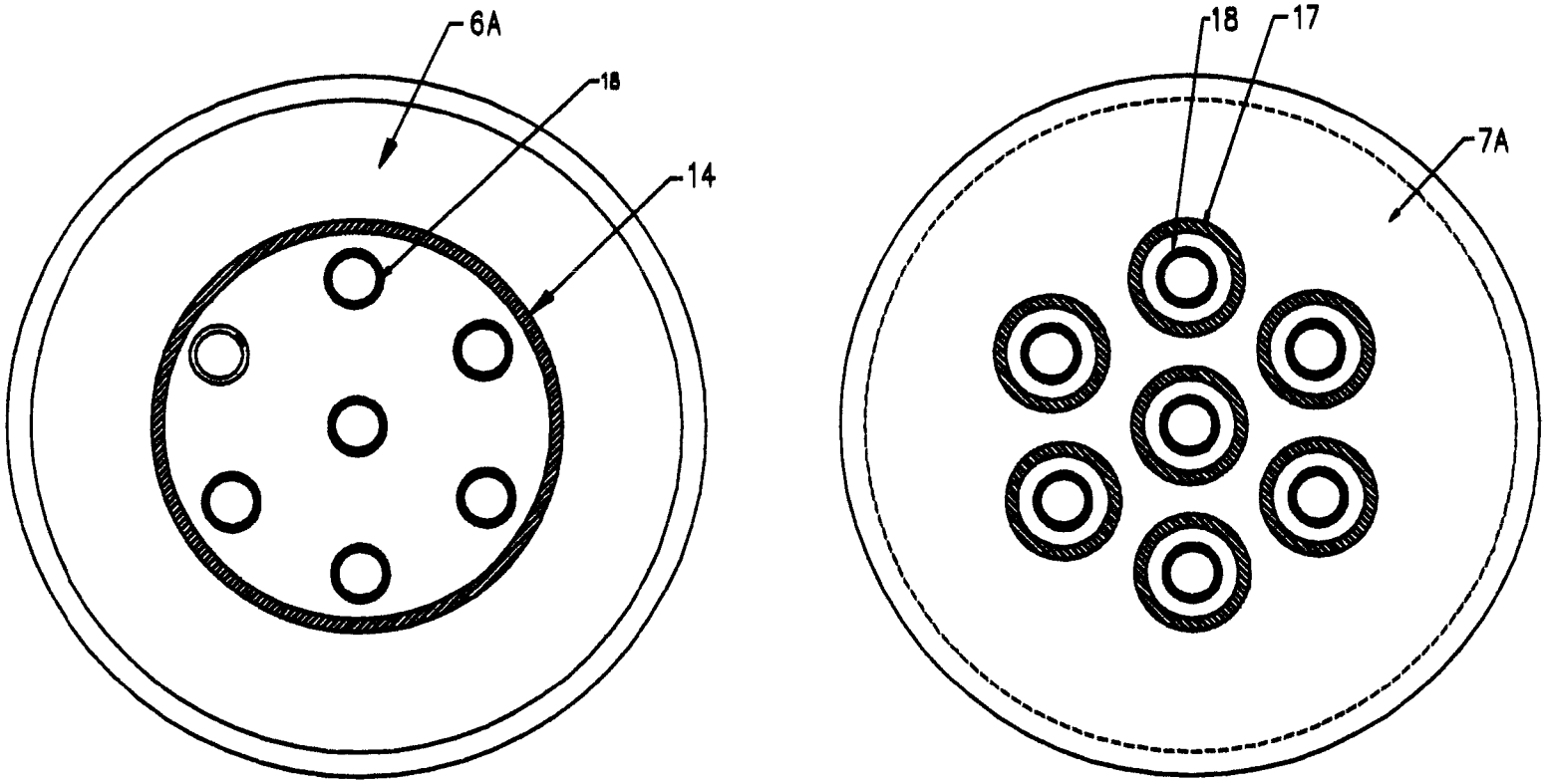
FIG. 6 shows details of the tube sheets on the product outlet chamber as viewed from product inlet side of heat exchanger. These views also show tubes and cores.

First and second tube sheets are connected together by a quick release clamps and form a leak proof joint with gaskets 13A and core tube in place. Use of such quick release clamps are known to those skilled in art and widely used in different shape and sizes. Alternatively, these two tube sheets can also be connected with bolts and nuts. Flange 6A is connected to third tube sheet 7A with a flat gasket 8 between them. Flat gasket 8 is made from food grade synthetic soft materials like Butyl or Nitrile rubber. FIG. 6 shows flange 6A and tube-sheet 7A as viewed from side of the heat exchanger. For better perspective, cross section views of middle tubes 17 and cores 18 are shown also. The flange 6A and tube-sheet 7A are secured by a quick release clamp and together form a leak proof seal between flange and tube sheet 7A. Product inlet chamber has a product inlet port welded into the tube 14 which allows the product through the product inlet chamber and into the heat exchanger module.

Product outlet chamber 3 consists of a tubular section 15 having a flange 6B at one end and a tube sheet designated as second tube sheet SB at the other end. Second tube sheet is connected to another tube sheet designated as the first tube sheet 4B. First tube sheet has holes drilled through it, which are somewhat larger than the core diameter. Second tube sheet SB has equal number of matching bores that are larger than those in the first tube sheet 4B. These holes are tapered with increasing diameter towards the first tube sheet. A gasket 13B is inserted in each of the hole, which seals the inner core's 18 outer surface and second tube sheet SB. These gaskets are made of food grade Teflon or similar hard synthetic material like.

First and second tube sheets are connected together by a quick release clamps and form a leak proof joint with gaskets 13B and core tube in place. Use of such quick release clamps are known to those skilled in art and widely used in different shape and sizes. Alternatively, these two tube sheets can also be connected with bolts and nuts. Flange 6B is connected to third tube sheet 7B with a flat gasket 8 between them. Flat gasket 8 is made from food grade synthetic soft materials like Butyl or Nitrile rubber. The flange 6B and tube-sheet 7B are secured by a quick release clamp and together form a leak proof seal between flange and tube sheet 7B. Product outlet chamber has a product outlet port 12 welded into the tube 15 which receives product form the middle section of the heat exchanger module and carries it out side the module.

When in use, the product enters inlet port 11, passes through inlet chamber, enters annular spaces between middle tubes 17 and inner cores 18 in the middle section, heat exchange taking place in the middle section between product in the annular spaces and medium flowing in the shell section of the middle section. The product then exits from the other end of the middle section into the open space in the product outlet chamber and out of module though outlet port 12. The medium on the other hand enters the middle section 1 through inlet port for medium 10 which is located at the product outlet end, passes through the shell side of the middle section and leaves the heat exchanger through outlet port for medium 9. A counter current flow is thus established between the product and medium.

Heat exchanger as shown in FIG. 1 and described above forms one module and for a typical applications more than one such modules can be arranged in series and/or in parallel with properly connecting the product and media ports. Such arrangement is known to those skilled in the art.

Figure 8:
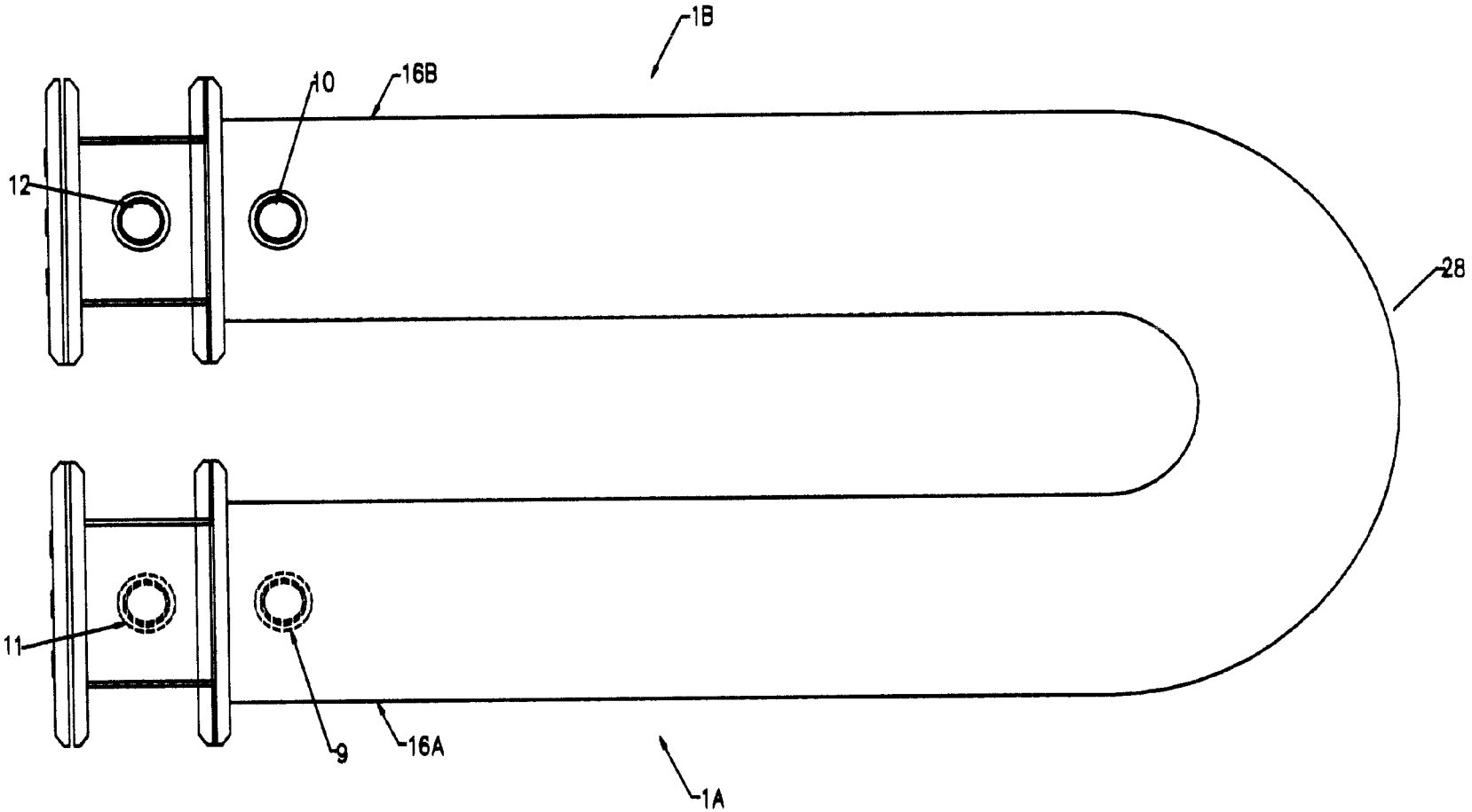
FIG. 8 is a top view of a single heat exchanger module with hair pin design.
Figure 9:
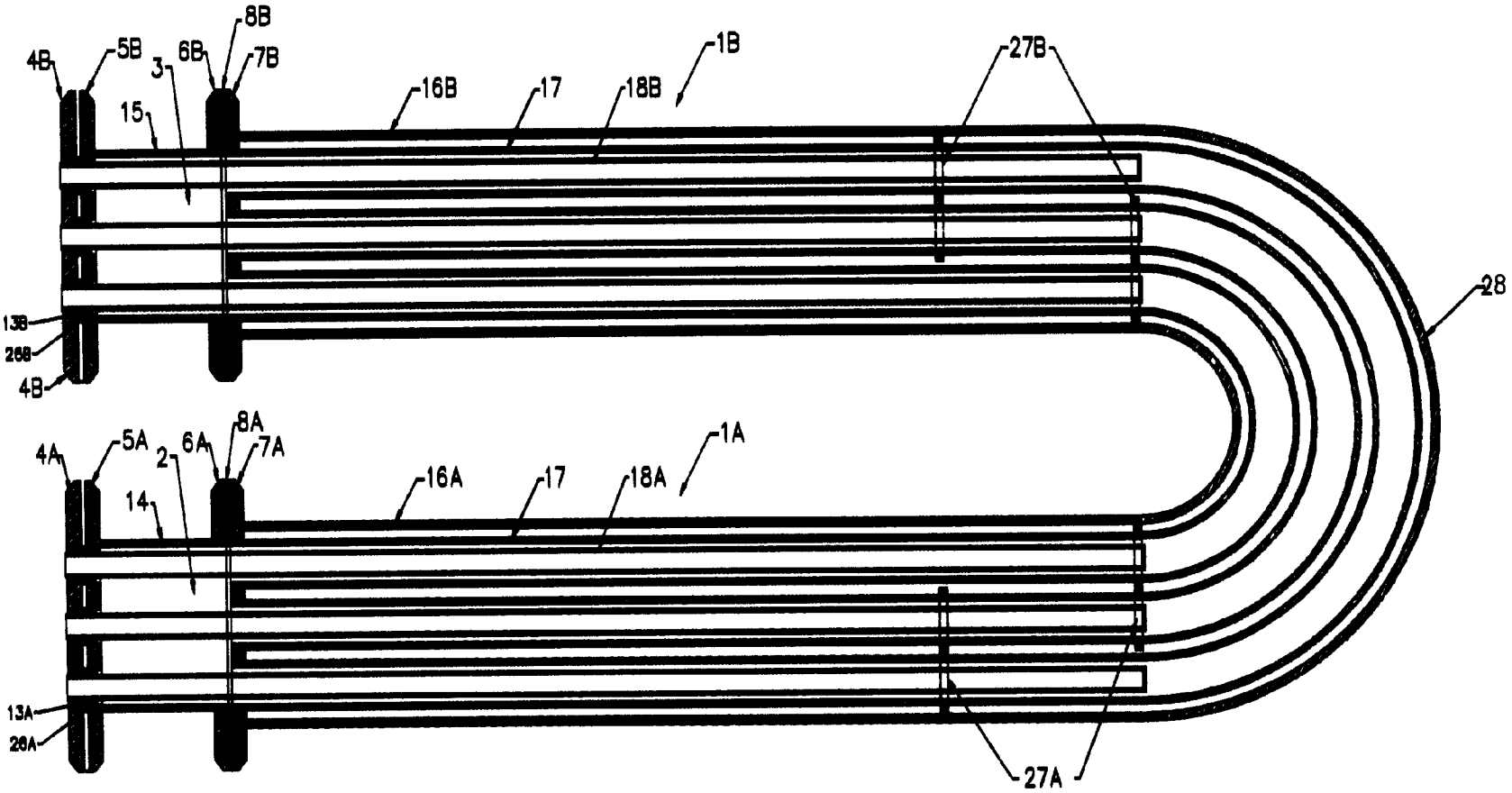
FIG. 9 is a cross sectional view of the heat exchanger of FIG. 8.
Figure 10:
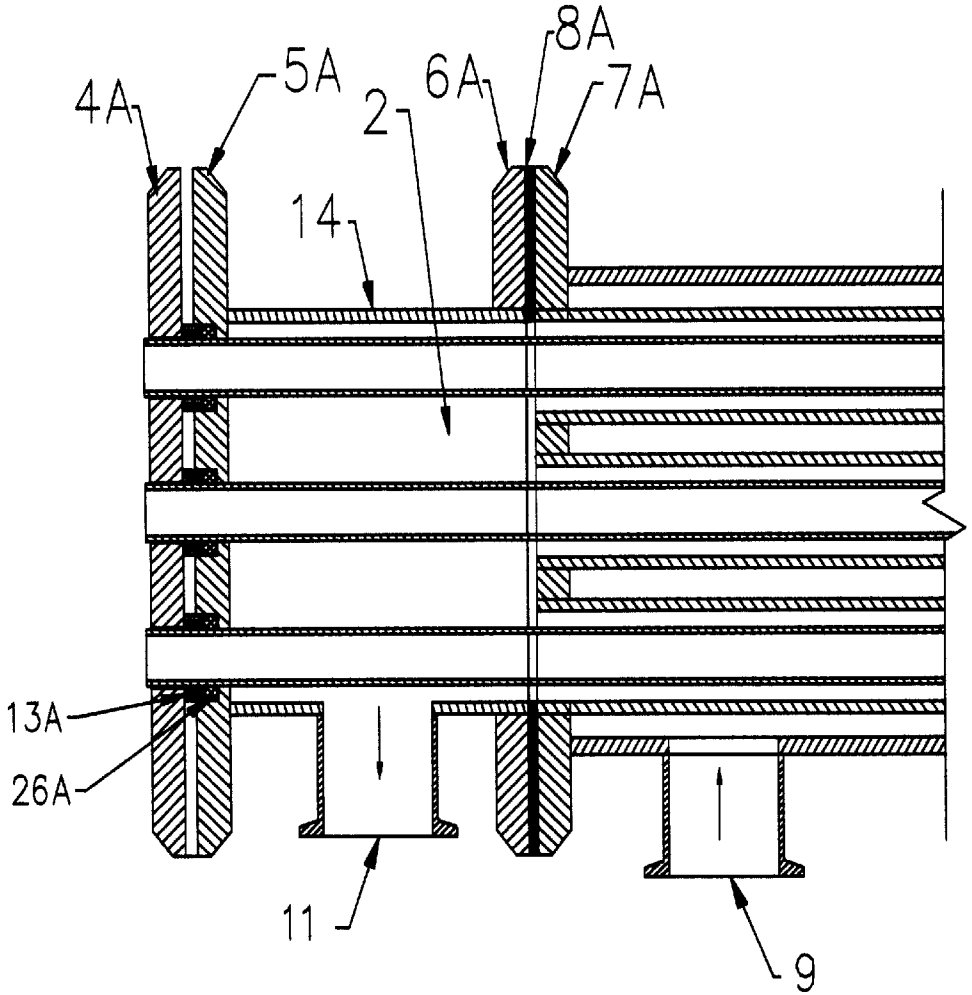
FIG. 10 shows a side and partial cross sectional view of the product inlet chamber of the heat exchanger of FIG. 8.
Figure 11:
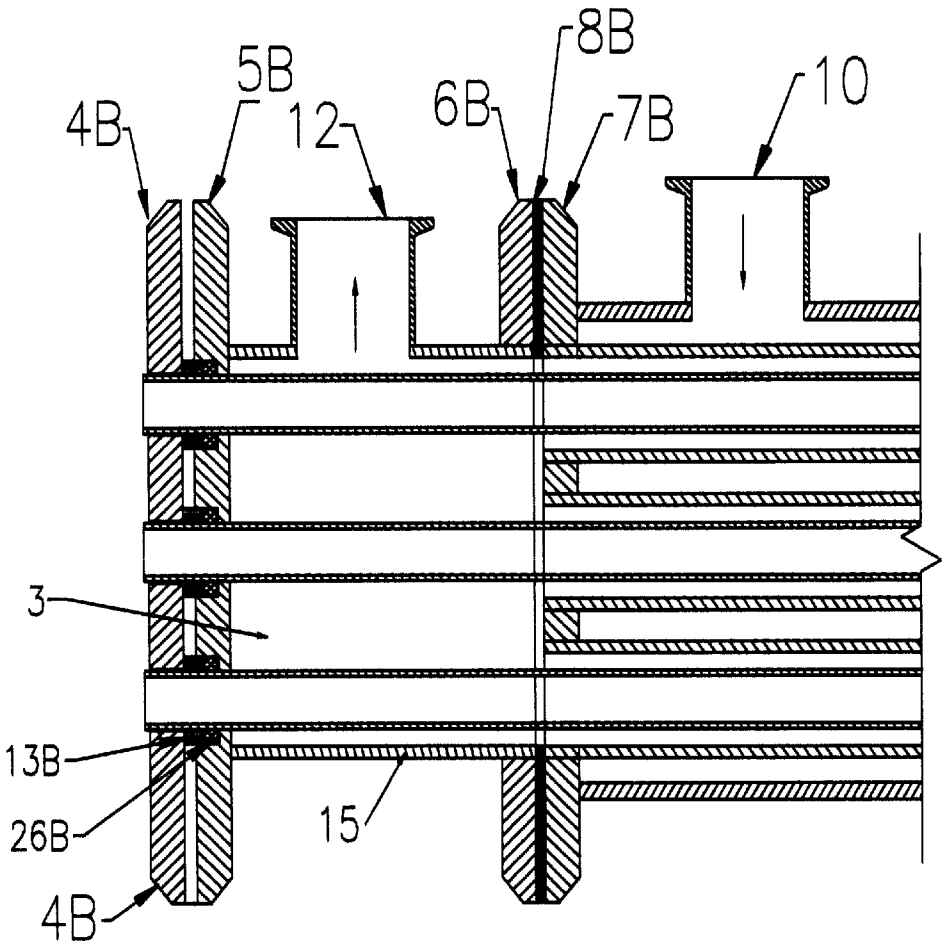
FIG. 11 shows a side and partial cross sectional view of the product outlet chamber of the heat exchanger of FIG. 8.

The present invention can also take the form of a multi tube heat exchanger having hair pin design as shown in FIG. 8 and FIG. 9. This form consists of a middle section which include 1A,1B and a 180° U-bend 28; a product inlet chamber 2 at one end, and outlet chamber 3 at the other end of the middle section. FIG. 8 shows top view of a typical heat exchanger module and FIG. 9 shows a cross section view of the heat exchanger module. Various parts, which are similar in construction and function but located at product inlet and outlet chamber end respectively, are designated by placing suffix A and B; for example, first tube sheet is designated as 4A and 4B.

The middle section 1A consists middle tubes 17, 16A and third tube sheet 7A at one end while 1B consists middle tubes 17, 16B and tube sheet 7B at one end. One end of outer tubes 16A and 16B is welded to tube sheets 7A and 7B respectively while the other end is welded to U-bend 28. Tube supports 27A and 27B which keep the middle tubes in proper position and yet allow flow of medium around them are slid through the bundle of middle tubes. Only two such supports are shown in the figure, but the number could vary depending upon the length of the section 1A and 1B. Middle tubes 17 are bent 180° and passed through the U-bends before 16A and 16B are welded to the U-bends. Tube sheets 7A and 7B have bores drilled through them. There are as many bores as are the middle tubes 17 and diameter of the bores is about the same as the outer diameter of these tubes. Middle tubes are inserted into these bores. The ends of middle tubes 17 are then expanded into or welded onto the tube sheets 7A and 7B.

Through each middle tube 17 of the middle section 1A and 1B, passes one internal core 18A and 18B respectively which is smaller in diameter than the middle tubes 17. The length of the core is such that the free end reaches the point where the U-bend is joined or a little farther. Although the cores are shown as hollow round tube blocked at the end which is near the U-bend 28 in the present invention, they can be in the form of solid round roads also, as no liquid flows through them. The free end is kept in place by welding small metal piece to the outer surface of the core. Such support design arrangements are known to those skilled in the art. A number of annuli are formed between the core and middle tube in the middle section 1A and 1B and product flows through these annuli. The straight sections of middle section thus become the area of heat exchange where heat transfer takes place between product stream in the annular space and medium in the shell. In the U-bend region, the heat transfer takes place between the middle tubes and medium. The heat exchanger module presented here consists of seven annuli, but this number could be any depending upon a specific application, so as to have an optimum shear rate and pressure drop combination. The middle tube and core tube may have a plain surface or a modified surface to generate some turbulence at the heat transfer region. This modification of surface is accomplished by any method known to those skilled in the art. The product inlet and outlet chambers are similar in construction except for the inlet and outlet ports which are located at opposite sides or other suitable places on the chamber tube 14 and 15 so as to facilitate easy connections with other modules in the case where more than one such modules are required to be connected in series.

Product inlet chamber 2 consists of a tubular section 14 having a flange 6A at one end and a tube sheet designated as second tube sheet 5A at the other end. Second tube sheet is connected to another tube sheet designated as the first tube sheet 4A. First tube sheet has holes drilled through it, which are somewhat larger than the core diameter. Second tube sheet 5A has equal number of matching bores that are larger than those in the first tube sheet 4A. These holes are tapered with increasing diameter towards the first tube sheet. A gasket 26A and a solid ring 13A are inserted in each hole, which seal the outer surface of inner core 18A and second tube sheet 5A. 26A is made from food grade synthetic soft materials like Butyl or Nitrile rubber, while 13A is made from hard synthetic material or stainless steel.

First and second tube sheets are connected together by a quick release clamps and form a leak proof joint with gaskets 13A and core tube in place. Use of such quick release clamps are known to those skilled in art and widely used in different shape and sizes. Alternatively, these two tube sheets can also be connected with bolts and nuts. Flange 6B is connected to third tube sheet 7B with a flat gasket 8 between them. Flat gasket 8A is made from food grade synthetic soft materials like Butyl or Nitrile rubber. The flange 6A and tube-sheet 7A are secured by a quick release clamp and together form a leak proof seal between flange and tube sheet 7A. Product inlet chamber has a product inlet port welded into the tube 14 which allows the product through the product inlet chamber and into the heat exchanger module.

Product outlet chamber 3 consists of a tubular section 15 having a flange 6B at one end and a tube sheet designated as second tube sheet 5B at the other end. Second tube sheet is connected to another tube sheet designated as the first tube sheet 4B. First tube sheet has holes drilled through it, which are somewhat larger than the core diameter. Second tube sheet 5B has equal number of matching bores that are larger than those in the first tube sheet 4B. These holes are tapered with increasing diameter towards the first tube sheet. A gasket 26B and a solid ring 13B are inserted in each hole, which seal the outer surface of inner core 18B and second tube sheet 5B. 26B is made from food grade synthetic soft materials like Butyl or Nitrile rubber, while 13B is made from hard synthetic material or stainless steel.

First and second tube sheets are connected together by a quick release clamps and form a leak proof joint with gaskets 13B and core tube in place. Use of such quick release clamps are known to those skilled in art and widely used in different shape and sizes. Alternatively, these two tube sheets can also be connected with bolts and nuts. Flange 6B is connected to third tube sheet 7B with a flat gasket 8B between them. Flat gasket 8B is made from food grade synthetic soft materials like Butyl or Nitrile rubber. The flange 6B and tube-sheet 7B are secured by a quick release clamp and together form a leak proof seal between flange and tube sheet 7B. Product outlet chamber has a product outlet port 12 welded into the tube 15 which receives product form the middle section of the heat exchanger module and carries it out side the module.

When in use, the product enters inlet port 11, passes through inlet chamber, enters annular spaces between middle tubes 17 and inner cores 18A in the middle section 1A, further flowing though the middle tubes in U-bend, again entering annular spaces between middle tubes 17 and inner cores 18B in the middle section 1B. The product then exits from the other end of the middle section into the open space in the product outlet chamber and out of module though outlet port 12. Heat exchange taking place in the middle section between product in the annular spaces and medium flowing in the shell section of the middle section and also between middle tubes 17 and medium flowing in the U-bend. The medium on the other hand enters the middle section 1B through inlet port for medium 10 which is located at the product outlet end, passes through the shell side of the middle section 1B, U-bend, through the shell side of the middle section 1A and leaves the heat exchanger through outlet port for medium 9. A counter current flow is thus established between the product and medium.

Heat exchanger as shown in FIG. 8 and FIG. 9 and described above forms one module and for a typical applications more than one such modules can be arranged in series and/or in parallel with properly connecting the product and media ports. Such arrangement is known to those skilled in the art.

Since this version of invention has a U-bend, it accommodates thermal expansion and contraction of the tubes and hence expansion joint is not required which simplifies the construction and lowers down the cost. Another advantage is that the product passes through annular space and round tube in successively which has a mixing effect and consequently heat transfer is increased.

Figure 12:
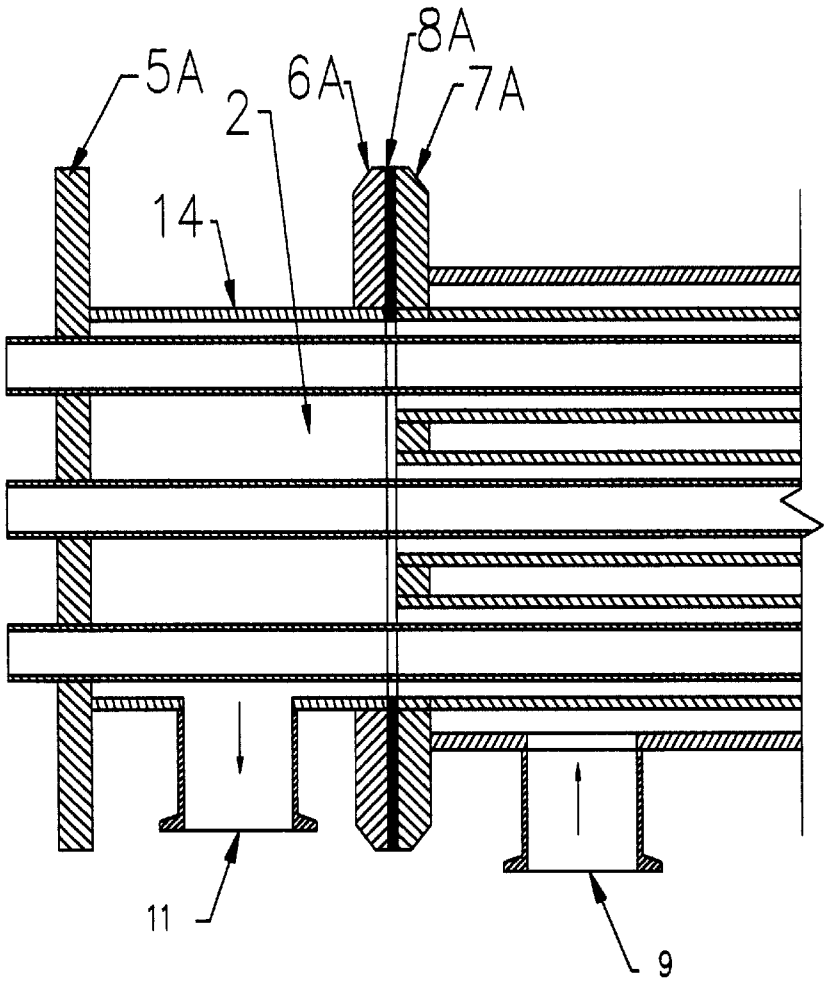
FIG. 12 shows the cross sectional view of product inlet chamber with core tubes welded to the tube sheet.
Figure 13:
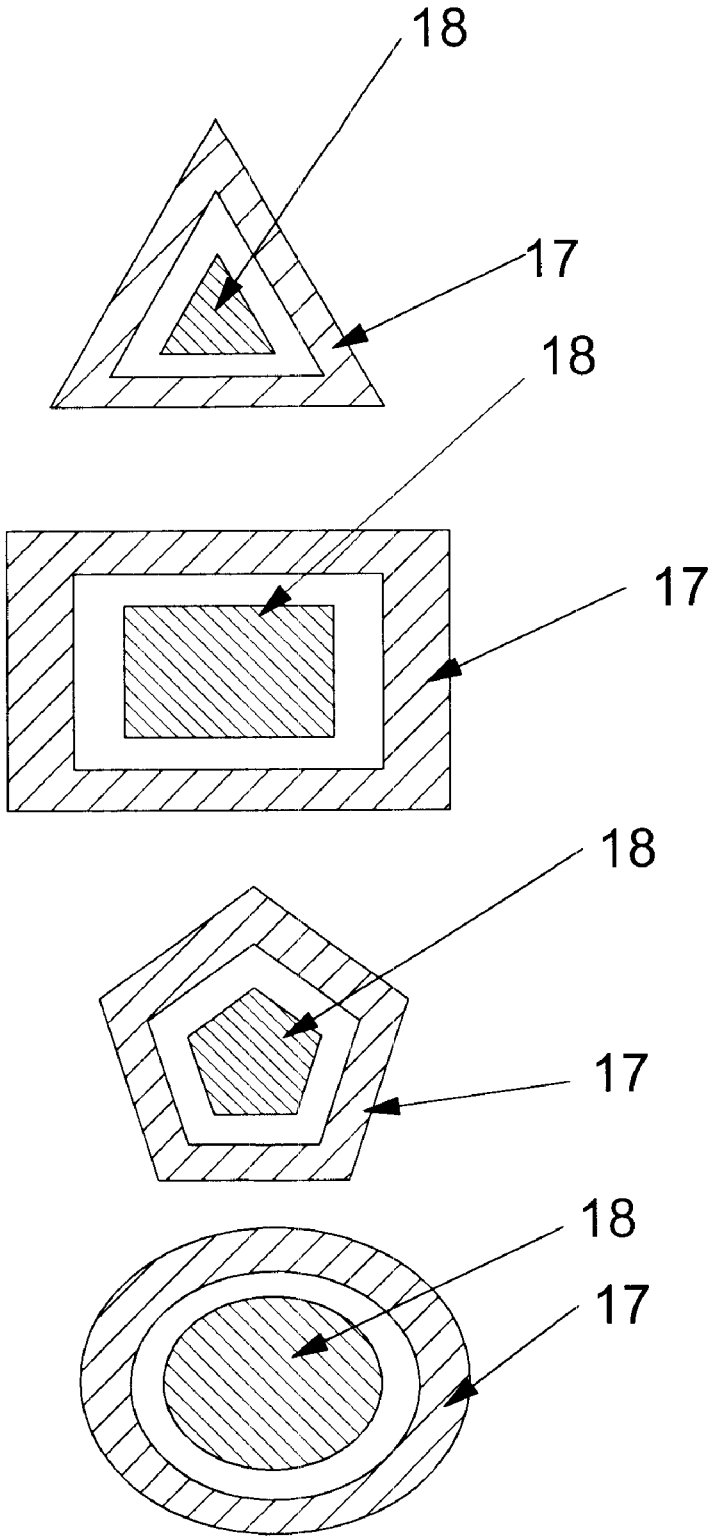
FIG. 13 shows cross sections (as in FIG. 6) of a middle tube 18 and a core 17 (i.e., insert) of, from top to bottom, triangular, square or rectangular, oval, and other polygonal forms of the inserts forming a similarly shaped annular space between the insert and the middle tube, and where the insert is shown as a solid rod.

FIG. 12 shows yet another variation in the way the core tubes are secured at both ends in the form of invention described in FIG. 8 and FIG. 9. Here, the core tubes are secured to the tube sheet 5A by expanding or welding on the tube sheet after passing through the tube sheet, thus eliminating the need for any seals between the tube and tube sheet. This feature essentially integrates all core tubes 18, 14, 5A and 6A as one unit which can be taken out and assembled as one unit.

The significant advantages offered by the present invention are explained in the following illustration. This analysis is based on several observations on heat transfer and pressure drops in annular space and round cross sections of tubular heat exchangers. In this illustration a comparison is made between a multi-tube heat exchanger the form which is known to those skilled in prior art and the present invention. Multi tube heat exchanger can have any diameter for the outer shell and it can house any number of tube bundles with suitable diameter. For comparison purpose a multi tube an with a 4" shell and 19 tubes each of 0.5" diameter forming the inner tube bundle inside the shell is considered. Similarly, the present invention can have any size of outer tube and can have any number of annular spaces formed by tube of any suitable size and any suitable diameter core. For comparison purpose, new invention with 4" outer tube and 7 annular spaces formed by 1" diameter tube and 0.5" core in the center of each tube is considered. In first example, an application for cooling a non-Newtonian fluid with a flow behavior index is 0.4, consistency index of 9 Pa. 5" and a flow rate of 40 GPM is considered. The cooling is from 80 F. to 40 F. with cooling water entering the heat exchanger at 34 F. and leaving at 43 F. Multi tube would yield an over-all heat transfer coefficient of 67 BTU/ft2.h.0 F. requiring about 600 ft2 of heat transfer surface, which can be provided by 24 multi tubes each of 10' length. The estimated pressure drop will be 134 psi. This configuration will hold up 30 gallons of product. For the same application, the present invention would yield an over-all heat transfer coefficient of 182 BTU/ft2.h. 0 F. requiring only about 220 ft2 of heat transfer surface, which will be provided by 12, tubes each of 10' length. The estimated pressure drop will be 134 psi. This configuration will hold up 19.3 gallons of product. The superior performance of the new invention is attributed to lower pressure drops at higher shear rates and higher over-all heat transfer coefficient.

In second example, an application for cooling a thick liquid food product exhibiting Newtonian behavior with an average viscosity of 110 cP and a flow rate of 40 GPM is considered. The cooling is from 80 0 F. to 40 0 F. with cooling water entering the heat exchanger at 34 F. and leaving at 43 F. Multi tube would yield an over-all heat transfer coefficient of 57 BTU/ft2.h. 0 F. requiring about 700 ft2 of heat transfer surface, which can be provided by 27 multi tubes each of 10' length. The estimated pressure drop will be 92 psi. This configuration will hold up 38 gallons of product. For the same application, the present invention would yield an over-all heat transfer coefficient of 144 BTU/ft2.h. 0 F. requiring only about 280 ft2 of heat transfer surface, which will be provided by 16, tubes each of 10' length. The estimated pressure drop will be 44 psi. This configuration will hold up 26 gallons of product. The high pressure in the case of multi Tubes can be brought down by having more parallel streams. For example, by providing more parallel streams, multi tube would yield an over-all heat transfer coefficient of 43 BTU/ft2.h. 0 F. requiring about 870 ft2 of heat transfer surface which can be provided by 35 multi tube each of 10' length. The estimated pressure drop will be 42 psi. Thus, in order to have similar pressure drops, multi tubes will require substantially large heat exchange surface. In this specific case, the pressure drop per tube at a specific flow rate is higher in the case of the new invention, but since the overall heat transfer coefficient is also significantly higher, one needs less surface meaning less tubes in series and so less pressure drop for the application.

It can be seen that the present invention is very efficient in heat exchange rate requiring about 2–3 times less heat exchange area and it also resulting in lower pressure drop through it. For many heat transfer applications in food industry the maximum pressure drop across the heat exchanger becomes a limiting factor because the pump used can handle only a certain maximum pressure drop at a given flow rate. Since less tube surface is required, volume held up in the tubes in present invention is also substantially low as compared to the conventional multi tube. The numbers of tubes, pressure drop and hold-up volume, will vary depending upon the type of product and application under consideration, however, the superior heat transfer characteristics of the present invention over the conventional multi tube heat exchanger will be consistently observed in all such applications.

The present invention attains optimum heat transfer and pressure drop performance as illustrated above when thick food products which thin out on shear or thick fluid with Newtonian behavior is pumped through the annular space while the medium is pumped through the shell. A majority of food product exhibits a non-Newtonian shear-thinning behavior and there are many other like yolk and sugar syrup, which are thick but are considered Newtonian for all practical purposes. During cooling such products, operating pressure drop scenario becomes the worst as the viscosity of such products increases exponentially at lower temperatures. The present invention works extremely well in this case as illustrated above and so can be used with distinct advantages.

In the case where the product is thin and Newtonian, the present invention offers similar thermal performance and works just as good as a conventional triple tubular heat exchanger, but will offer added advantage of one being more compact.

As used herein and unless specifically indicated as otherwise, the inserts of the present invention may be solid rods, filled or empty tubes, or other such structures adapted to be used in the invention heat exchangers to achieve the objects of the invention.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A multi-tube heat exchanger having a bundle of at least two straight product tubes for product flow having their inlets and outlets secured in and opening to product sides of separated tube sheets so that the product tubes are parallel and whose external heat transfer surfaces are all enclosed in a single liquid tight shell adapted to cause a heat transfer fluid to flow across those external surfaces, the improvement comprising:

(a) longitudinal inserts as solid rods and extending through two or more product tubes, such that the axes of the inserts and product tubes through which the inserts extend are substantially the same and an annular space is defined by an inner surface of the product tube and an outer surface of the insert, the annular space being adapted to yield effectively high shear rates causing substantial shear thinning of a shear sensitive thick liquid to be passed through the annular space; and (b) a separate liquid tight chamber about each product side, where each liquid tight chamber comprises a securing plate substantially normal to the axes of the product tubes so that each insert extends from an end secured to the securing plate, across the space of each liquid tight chamber through which the shear sensitive thick liquid flows during operation, and then into an opening of a product tube.

2. The exchanger of claim 1 wherein the cross section shape of the inserts and inside surfaces of the product tubes into which they extend are cylindrical or oval, forming a substantially uniform annular space.

3. The exchanger of claim 1 wherein the cross section shape of the inserts and inside surfaces of the product tubes into which they extend are triangular, square, rectangular or otherwise polygonal, forming a substantially uniform annular space.

4. The exchanger of claim 1 wherein the inserts are tubes with a bore from end to end.

5. The exchanger of claim 4 wherein the tube bore removes sufficient material as compared with a solid rod of about the same outer dimensions that substantial sagging of the rod insert is prevented and also making the heat exchanger light weight.

6. The exchanger of claim 1 wherein the liquid tight shell comprises expansion joint means.

7. The exchanger of claim 6 wherein the expansion joint means comprise forming the shell in two parts and sealing the joint between the two parts with a two part gasket and bushing for gasket replacement without complete disassembly of the exchanger, where the expansion joint means are adapted to permit the product tubes to expand or contract along their axes a different rate than an expansion or contraction of the shell along the same direction.

8. The heat exchanger of claim 1 wherein the annular distance from the inner surface of the product tube and the outer surface of the insert is substantially uniform with an average annular distance of from about 0.1 inches to about 0.55 inches.

9. A multi-tube heat exchanger having a bundle of at least two U-shaped product tubes for product flow having their inlets and outlets secured in and opening to product sides of separated tube sheets so that straight portions of the U-shaped product tubes are parallel and whose external heat transfer surfaces are all enclosed in a single U-shaped liquid tight shell adapted to cause a heat transfer fluid to flow across those external surfaces, the improvement comprising:

(a) a longitudinal insert extending substantially through the straight portions of the U-shaped product tubes, such that the axes of the inserts and straight portions of the product tubes through which the inserts extend are substantially the same and an annular space is defined by an inner surface of the straight portion of the product tube and an outer surface of the insert, the annular space being adapted to yield effectively high shear rates causing substantial shear thinning of a shear sensitive thick liquid to be passed through the annular space;

(b) a separate liquid tight chamber about each product side, where each liquid tight chamber comprises a securing plate substantially normal to the axes of the straight portions of the product tubes so that each insert extends from an end secured to the securing plate, across the space of each liquid tight chamber through which the shear sensitive thick liquid flows during operation, and then into an opening of a product tube.

10. The exchanger of claim 9 wherein the cross section shape of the inserts and inside surfaces of the product tubes into which they extend are cylindrical or oval, forming a substantially uniform annular space.

11. The exchanger of claim 9 wherein the cross section shape of the inserts and inside surfaces of the product tubes into which they extend are triangular, square, rectangular or otherwise polygonal, forming a substantially uniform annular space.

12. The exchanger of claim 9 wherein the inserts are tubes with a bore from end to end and an end extending into a product tube is capped off.

13. The exchanger of claim 12 wherein the tube bore removes sufficient material as compared with a solid rod of about the same outer dimensions that substantial sagging of the rod insert is prevented.

14. The exchanger of claim 9 wherein insert is a solid rod.

15. The heat exchanger of claim 9 wherein the annular distance from the inner surface of the product tube and the outer surface of the insert is substantially uniform with an average annular distance of from about 0.1 inches to about 0.55 inches.

* * * * *